US011414849B2

(12) United States Patent
Sonoda

(10) Patent No.: US 11,414,849 B2
(45) Date of Patent: Aug. 16, 2022

(54) HAND WASH AND DUMP SINK ASSEMBLY

(71) Applicant: Naoki Sonoda, Palatine, IL (US)

(72) Inventor: Naoki Sonoda, Palatine, IL (US)

( * ) Notice: Subject to any disclaimer, the term of this patent is extended or adjusted under 35 U.S.C. 154(b) by 0 days.

(21) Appl. No.: 16/867,870

(22) Filed: May 6, 2020

(65) Prior Publication Data

US 2020/0354934 A1 Nov. 12, 2020

Related U.S. Application Data

(60) Provisional application No. 62/846,704, filed on May 12, 2019.

(51) Int. Cl.
*E03C 1/186* (2019.01)
*E03C 1/182* (2006.01)

(52) U.S. Cl.
CPC ..... *E03C 1/186* (2013.01); *E03C 1/182* (2013.01)

(58) Field of Classification Search
CPC ..... E03C 1/14; E03C 1/16; E03C 1/18; E03C 1/181; E03C 1/182; E03C 1/186; E03C 2201/90; A47J 47/20; A47K 1/00; A47K 1/04; A47K 1/12; A47L 19/00; A47L 19/02; A45D 19/04; A45D 19/06; A45D 19/08; A45D 19/10; A45D 19/12
USPC ..... D23/284, 287, 308, 286, 285
See application file for complete search history.

(56) References Cited

U.S. PATENT DOCUMENTS

| | | | | | |
|---|---|---|---|---|---|
| 202,193 | A * | 4/1878 | Reid | E03C 1/14 | 4/307 |
| 928,425 | A * | 7/1909 | Caldwell | E03C 1/18 | 4/637 |
| 929,820 | A * | 8/1909 | Bond | 4/627 | |
| 1,259,873 | A * | 3/1918 | Kaplan | A47L 19/02 | 137/562 |
| 1,648,386 | A * | 11/1927 | Grover | E03C 1/14 | 4/630 |
| 2,008,349 | A * | 7/1935 | Crane | E03C 1/18 | 4/637 |
| 3,206,770 | A | 9/1965 | Carlson | | |
| 3,346,886 | A * | 10/1967 | Kashiwamura | E03C 1/186 | 4/637 |
| 3,579,656 | A | 5/1971 | Guarrasi | | |
| 3,611,450 | A | 10/1971 | Bost | | |
| 5,412,818 | A | 5/1995 | Chen | | |
| 7,954,183 | B2 * | 6/2011 | Cawthon | A22C 17/08 | 4/650 |
| 8,104,114 | B2 | 1/2012 | Ton | | |
| D888,209 | S * | 6/2020 | Knuth | D23/290 | |
| 2004/0003460 | A1 | 1/2004 | Zolotnik | | |
| 2005/0155147 | A1 * | 7/2005 | Trepanier | A47K 3/281 | 4/630 |
| 2005/0199841 | A1 * | 9/2005 | O'Maley | E03C 1/057 | 251/129.04 |

* cited by examiner

*Primary Examiner* — Erin Deery
(74) *Attorney, Agent, or Firm* — MBIP Law LLC; Maheen Baber

(57) ABSTRACT

A wash sink and dump sink assembly comprising: A combination sink, comprising of a housing structure with two full length side walls, a full length back wall, a floor, a shorter front wall and four supporting legs; a drainage means situated at the floor of the housing structure; a faucet located at the head of the back wall of the housing structure; and a tray structure resting on pegs inserted into the side walls of the housing structure.

12 Claims, 3 Drawing Sheets

HAND WASH AND DUMP SINK ASSEMBLY

CROSS REFERENCE TO RELATED APPLICATION

This application claims the benefit of U.S. Provisional Application No. 62/846,704 filed on May 12, 2019, the disclosure of which is incorporated herein by reference.

BACKGROUND

Field of the Invention

The present invention generally relates to hand-wash and dump sinks and more specifically relates to a new apparatus that serves as a combination sink for hand washing and wet waste disposal.

Description of the Related Art

Commercial establishments, such as bars have a health code requirement to have at least one hand washing station. Further, hand sinks may not be used for purposes other than hand washing, a dump sink is required for the disposal of liquid matter from bussed glasses and other tableware.

Using hand wash sinks for dumping wet waste and using dump sinks for hand washing is considered unsanitary practice by health departments, as this increases the risk of contamination. The lack of differentiation in design between hand wash and dump sinks (they are identical designs that are specified for different purposes) results in high occurrences of user error, where users indiscriminately co-mingle the tasks of hand washing and wet waste dumping in both types of sinks. There are no design elements of these sinks that suggest that hand wash sinks or dump sinks should be used exclusively for the purpose they were intended. Therefore, it is impossible to control how the sinks are used in practice.

In foodservice operations such as a bars or coffee shops, single-basin sinks are installed in service areas to be utilized by employees for specific purposes. Single-basin sinks designated as "hand wash sinks" are intended to be used exclusively for hand washing, while single-basin sinks designated as "dump sinks" are intended to be used exclusively for dumping wet waste. Wet waste is the remaining contents of beverages served to patrons (ice, lemon or lime wedges, straws, garnish picks, etc.). Hand wash and dump sinks are intended to be used for separate tasks to decrease the risk of contamination.

Despite their intended purposes, hand wash sinks and dump sinks are often utilized improperly due to their common design (size, shape, dimensions, construction, materials, etc.). A single basin sink becomes a hand wash or dump sink due to its placement within a bar, but is not inherently one or the other by design. Both are single-basin sinks that have hot and cold tap handles, a faucet, and a drain. Due to the fact that there are no obvious design elements that differentiate one from the other, foodservice workers often use dump sinks for hand washing, and hand wash sinks for dumping. This is problematic because it increases the risk of contamination and is considered a violation of health code.

Foodservice operators try to prevent this misuse of hand wash and dump sinks by using "hand wash only" or "dump sink only" signage placed near the sinks, but this does not guarantee proper usage. In practice, foodservice workers often revert to improperly using these sinks out of habit and convenience, especially during high-volume periods when they are in a rush to provide fast service.

The Unsanitary Practice of Hand Wash Sinks and Dump Sinks Used as Holding Basins for Bar Tools Bartenders often use hand wash and dump sinks as holding basins for their beverage-making tools (mixing tins, mixing glasses, measuring jiggers, cocktail strainers). For example, it is common practice for a bartender to place mixing tins used to shake drinks into a hand wash or dump sink immediately after shaking a drink. When the bartender needs to make the next drink, they will often use those tins without properly washing, rinsing, and sanitizing them. Most of the time, they will only rinse the tins. This is unsanitary practice, and is a health code violation. This kind of behavior occurs due to convenience and proximity, as hand wash and dump sinks are often placed near bar workstations. In addition, because these sinks are almost always located under the bar and out of clear view, patrons are not able to see this unsanitary practice when it happens.

The Unsanitary Practice of Filling Vessels and Rinsing Blender Pitchers in Hand Wash and Dump Sinks Out of convenience, foodservice workers often fill water pitchers by leaving them upright in a hand wash or dump sink, turning on the taps, and then tending to other tasks while the pitchers fill with water. The water pitchers will eventually be placed on a countertop or tabletop, which could transfer bacteria from the hand wash or dump sinks to these surfaces. Blender pitchers are also rinsed in the same manner that water pitchers are filled, and therefore, create the same contamination risks.

Foodservice workers are able to leave water pitchers and blender pitchers upright in hand wash or dump sinks because these common, single-basin sinks all have relatively flat and level floors. This allows the pitchers to fill without tipping over.

Therefore, what is needed is an improved system for being able to combine the hand washing and waste dumping into a single unit, while at the same time completely separating the acts of hand washing and wet waste dumping.

Statement of the Objectives

Accordingly it is an objective of the current invention to overcome the deficiencies of the prior art.

It is also an object of the present invention to provide a low cost means of hand washing and wet waste dumping.

Another object of the invention is to provide a combination hand wash and dump sink.

Another object of the invention is to provide a removable hand wash component.

A further object of the invention is to provide a dish washer safe hand wash component.

Still another object of the invention is to provide a hand wash component that serves as a physical barrier between the hand wash zone and the dump zone.

Yet another object of the invention is to provide an inclined hand wash component that prevents back splash during hand washing.

A further objective of the invention is to minimize the wastage of water.

Still another object of the invention is to provide an inclined hand wash component whose angle of inclination is adjustable.

Still a further object of the invention is separating the act of hand washing and wet waste dumping by design.

Other objects and advantages of the present invention will be set forth in part in the description and in the drawings that follow and, in part, rill be obvious from the description, or ay be learned by practice of the invention.

SUMMARY

Embodiments of the present invention provide a means utilizing hand washing and dump sink having improved efficiency and mechanical simplicity for reduced production costs.

Accordingly, the present invention discloses an improved and novel concept for a hand washing and dump sink assembly. The invention has as its principal objects to provide a simple yet effective means of achieving hand washing and wet waste disposal while minimizing any risk of contamination.

The objects of the invention are achieved by the provision of a wash sink and dump sink assembly comprising a combination sink, further comprising a housing structure with two side walls, a full length back wall, a floor, a shorter front wall and four supporting legs, a drainage means situated at the floor of the housing structure, a faucet located at the top extremity of the back wall of the housing structure, and a tray structure resting on pegs inserted into the side walls of the housing structure.

In accordance with embodiments of the invention the tray structure is removable.

In another embodiment of the invention the tray structure comprises of a back wall, two side walls, a downward inclining floor and a backward recessed portion located at the front extremity of the tilting floor.

In yet a further embodiment of the invention the downward inclining floor is smooth and non-porous.

In yet another embodiment of the invention the removable tray structure divides the combination sink into two zones.

In still another embodiment the top zone is exclusively for hand washing.

In another embodiment of the invention the bottom zone is for dumping wet waste.

In a further embodiment of the invention the downward inclining floor allows the used water from the faucet to flow into the bottom part of the combination sink.

In another embodiment of the invention the tray structure is dish washer safe.

Reference in the specification to one embodiment or an embodiment means that a particular feature, structure or characteristic described in connection with the embodiment is included in at least one embodiment of the invention. The appearance of the phrase "in one embodiment" in various places in the specification do not necessarily refer to the same embodiment.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

The present invention will now be described with reference to the following drawings, in which like reference numbers denote the same element throughout.

BRIEF DESCRIPTION OF THE DRAWINGS

Various exemplary embodiments of the methods of this invention will be described in detail with reference to the following figures, wherein.

DETAILED DESCRIPTION

Embodiments of the present invention are described more fully below with reference to the accompanying drawings, which form a part hereof, and which show exemplary embodiments for practicing the invention. However, embodiments may be implemented in many different forms and should not be construed as limited to the embodiments set forth herein; rather these embodiments are provided so that this disclosure will be thorough and complete, and will fully convey the scope of the invention to those skilled in the art. The following detailed description is, therefore, not to be taken in the limiting sense.

Figure 1:
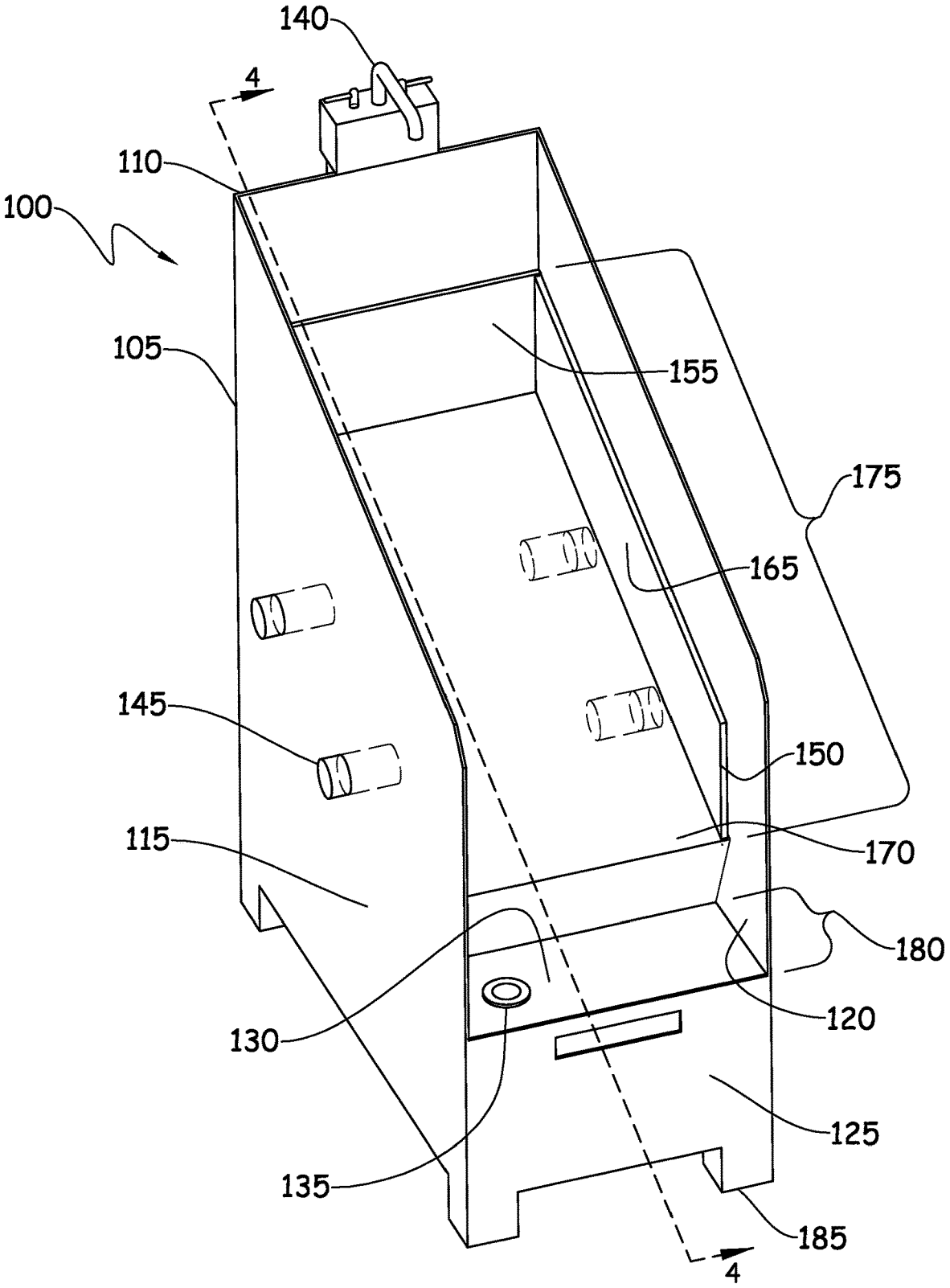
FIG. 1 is a front, perspective view of a preferred embodiment of a combination sink of this invention.

Referring now to the embodiment illustrated in FIG. 1, the figure illustrates a combination sink, 100, comprising a main housing 105, further comprising a full height back wall, 110, two side walls, 115 and 120, that meet a shorter front wall, 125, and a solid floor 130 with a drain 135. A faucet 140 that supplies hot and cold water is mounted at the top of the back wall, 110. An automatic sensor, foot pedals, knee pedals, or conventional handles may control the water flow from the faucet (not shown).

A preferred removable tray structure, 150, sits inside of the main housing 105. It rests on a plurality of pins, rails, ledges, rods (or any combination of these), 145, that are preferably affixed to the sidewalls 115, 120 of the main housing 100. The removable tray 150 comprises of a back wall, 155, two sidewalls, 165 and a solid floor, 170, with a downward incline (to be discussed further in the following figures). The removable tray, 150, divides the main structure into 2 distinct zones: a top zone, 175, exclusively for hand washing, which may also be referred to as the hand wash zone, and a bottom zone, 180, exclusively for dumping wet waste, which also may be referred to as the dump zone. The downward incline of the removable tray, 150, directs water used for hand washing to flow into the bottom zone, which also helps to melt ice that has accumulated in the bottom zone (along with other wet waste). The housing, 105, further rests on four supportive legs, 185. In another embodiment of the invention the combination sink, 100, may be mounted directly to a wall, versus being supported on four supportive legs, 185.

The combination sink, creates a scenario where gray water is recycled to help melt potable ice discarded from finished beverage serving vessels. Every time a user washes their hands in the top zone, 175, (hand wash zone), gray water flows into the bottom zone, 180, (dump zone) to melt discarded ice. This drastically decreases the ice that accumulates in dump sinks, which also decreases the water used for melting it. Bartenders often leave hot water running in order to melt ice in dump sinks, which is wasteful and costly. This helps to save water by continuously using gray water to melt ice throughout a shift.

The removable tray structure, 150, can be removed from the top zone, 175, and placed in an automatic glass washer or dishwasher to be washed and sanitized. The removable tray structure is also preferably made of non-corrosive material that can easily be placed in a dishwasher and not be damaged. The convenient design of such structure makes the likelihood of regularly washing of the sink more likely.

The design of the combination sink also clearly suggests to users where to wash one's hands, and where to dump wet waste, making best practices automatic. The design, therefore, creates an overall improvement in sanitation for the foodservice industry at large. In addition, for user convenience, paper towel and soap dispensers (not displayed) may be connected to the top of the main housing, 105.

Figure 2:
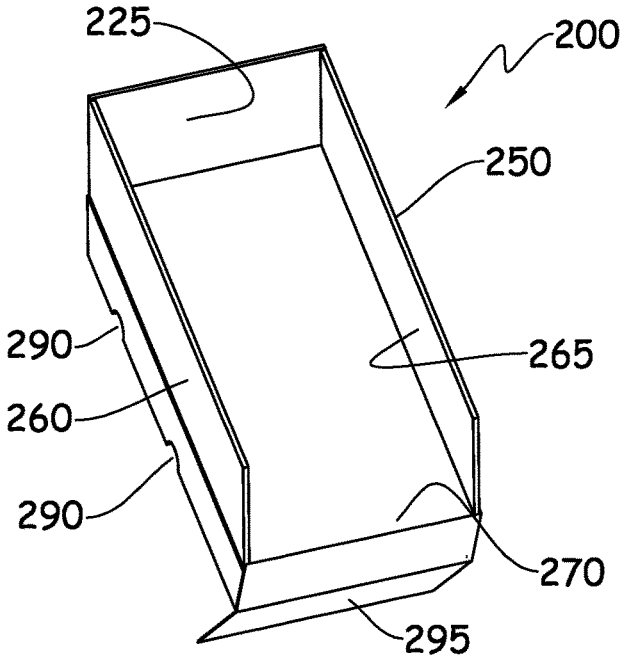
FIG. 2 is front perspective view of the removable tray in one embodiment of the invention.

Referring now to FIG. 2, a front perspective view of the removable tray structure, 250 is displayed. As stated earlier, the removable tray structure 250, has a back wall, 255, two side walls, 260 and 265, as well as a solid downward inclining floor, 270. In some embodiments (not shown) the forward tilt of the removable tray may also be adjustable. The downward incline may be adjustable for angles of inclination between 25-45 degrees.

The side walls, 260 and 265 further comprise slots 290. These slots, 290, allow the removable tray, 250 to rest on top of pins/nails/rods on the top zone of the combination sink, allowing the removable tray, 250, to be resting snugly, so as to ensure such tray stays in place during the hand washing/rinsing process. Further, the removable tray, 250, has a downward inclining or downward inclining floor, 270, to ensure that all the water that is being utilized is emptying into the bottom zone of the combination sink. Further, the downward inclining floor, 270, has a backward recessed portion, 295, at the edge of the floor, to ensure all the water from the tray flows to the bottom zone below. Moreover, the downward inclining floor is also smooth and non-porous to ensure the maximum flow of water into the lower zone.

Furthermore, the downward incline of the floor, 270, also prevents users from placing vessels on top of it to fill them with water, as users know intuitively that the downward pitch does not provide a level surface for facilitating this. As such, they are deterred from the unsanitary practice of placing vessels in sinks to fill them with water. The downward incline also suggests to users that they dump wet waste below it in the Dump Zone, or the bottom portion of the combination sink, 100, as dumping in the Hand Wash Zone would eventually cause the wet waste to fall into the Dump Zone naturally due to gravity. This design element directs the user to dump in the Dump Zone instead of the Hand Wash Zone—this sanitary practice becomes automatic through suggestive design. The downward incline also directs gray water produced from hand washing into the Dump Zone below to melt leftover ice from patrons' beverages, resulting in a more economical use of water.

Furthermore, the removable tray, 250, is a dishwasher safe component of the invention and can be washed, rinsed, and sanitized in an automatic dish washing machine. This allows the tray, 250 to provide a sanitary surface over which users can wash their hands. The removable aspect makes the sanitary practice of washing and sanitizing the surfaces surrounding a hand washing area convenient, and therefore, more likely. This is in stark contrast to a typical hand wash sink, which may not be properly washed and sanitized for weeks—even months—due to inconvenience and laziness.

The removable tray, 250 also physically divides the combination sink into two zones, the hand wash zone and the dump zone, thus acting as a physical barrier between the Hand Wash Zone and the Dump Zone. During hand washing, the removable tray, 250, prevents gray water from making direct contact with the wet waste below. This direct contact between the gray water and the wet waste risks the possibility of splash back that could contaminate the user's hands. The downward incline of the removable tray, 250, directs gray water away from the hands, and down into the Dump Zone. Conversely, when users dump wet waste into the Dump Zone, the Hand Wash Component acts as a physical barrier that prevents water from splashing upward and into the Hand Wash Zone. The Hand Wash Component effectively separates the act of hand washing and dumping by design.

Figure 3:
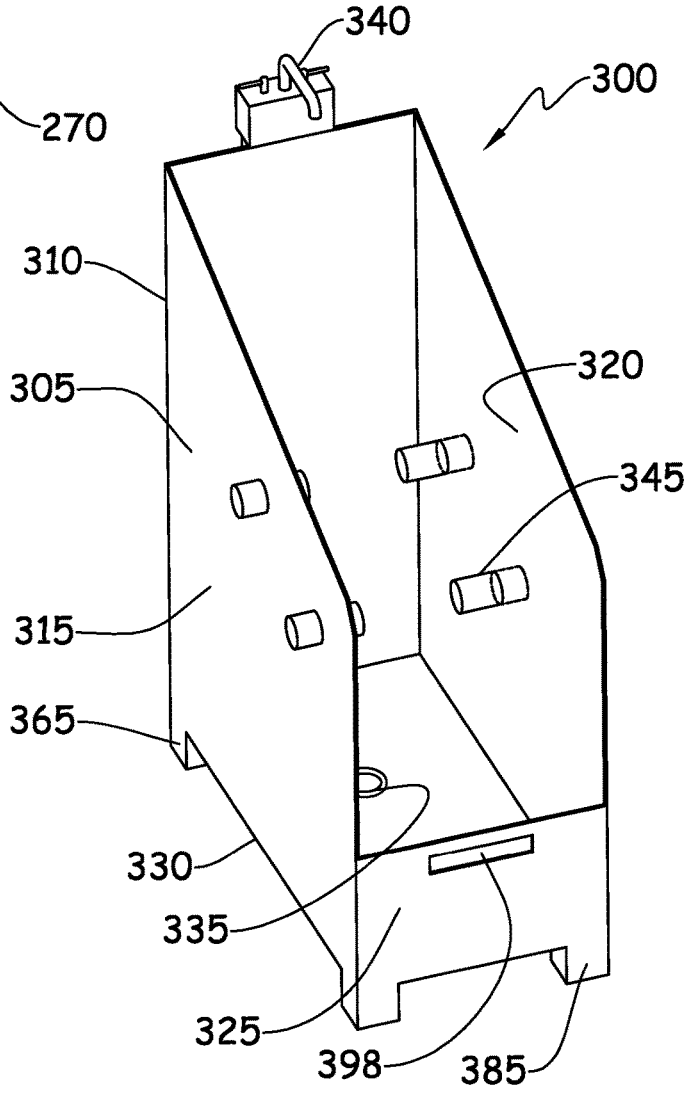
FIG. 3 is a front perspective view of the combination sink without the removable tray.

FIG. 3 is a front perspective view of the combination sink, 300, without the removable tray. The housing, 305 consisting of a full height back wall, 310, 2 side walls, 315 and 320, that meet a shorter front wall, 325, and a solid floor 330 with a drain 335. A faucet 340 that supplies hot and cold water is mounted near the top extremity of the back wall, 310. An automatic sensor, foot pedals, knee pedals, or conventional handles may control the water flow from the faucet. Furthermore, pegs, nails, or rods 345 upon which the removable tray can rest may either be bored into the side walls, 315, 320, or only borings may be present in the sidewalls, into which such pegs, nails or rods can be inserted into to allow the removable tray to rest upon. The housing, 305, further rests on four supportive legs, 385, which provide it with stability. In further embodiments of the invention the removable tray may be adjustable with regards to its angle of inclination. This may be possible by having various holes or slots in the side walls 315 and 320, into which the pegs, nails or rods 345, can be inserted into.

As indicated above, the removable tray divides the combination sink into two zones, and without such a tray structure, water from the faucet, 340, simply drops on the floor, 330 and goes down the drain, 335. Furthermore, there would be nothing to distinguish between the wash and dump zones, and this may create sanitary issues. Since most health codes require the placement of at least one hand wash sink and one dump sink in every bar, not having the removable tray would defeat this purpose.

Furthermore, this embodiment of the invention allows the main housing, 305, to comprise of a tray holder, or clip 398, attached to the front wall, 325. Such a tray holder, 398, allows a server or bartender to place a standard tray in the clip or holder, allowing them to dump the contents, of used beverage vessels, into the dump zone, with 2 hands.

Figure 4:
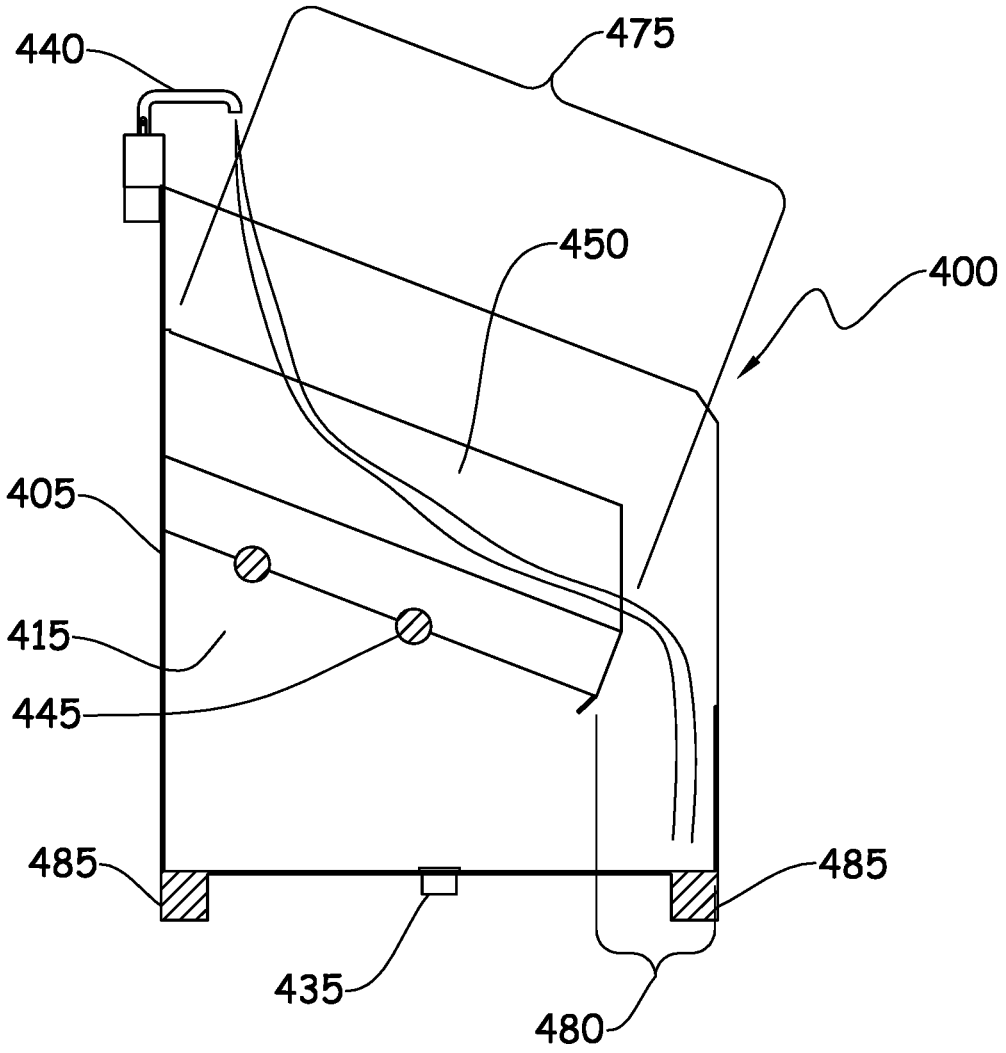
FIG. 4 is a side cross sectional view of the first embodiment of the combination sink taken along lines 4-4 of FIG. 1.

FIG. 4 is a cross-sectional view of one embodiment of the invention along lines 4-4 of FIG. 1, depicting the downward incline of the removable tray as well as the flow of water. The main housing, 405, of the combination sink, 400, comprises of the side wall, 415, into which pegs, nails, or rods 445 can be bored into. These pegs, nails or rods 445 allow the removable tray, 450 to rest on top of them for a snug, tight and stable fit. The removable tray, 450 divides the combination sink into two zones, a top hand washing zone, 475 and a bottom dump zone, 480. Water from the faucet 440, flows down the downward incline of the removable tray, 450, and into the dump zone 480. From there-on any dirty water flows down the drain, 435 and out. The legs, 485, provide the combination-sink with additional support and stability.

The gray water from the hand washing process further helps melt potable ice discarded from finished beverage serving vessels. Every time a user washes their hands in the top zone, 475, the dirty water water flows into the bottom zone, 480, to melt discarded ice. This drastically decreases the ice that accumulates in dump sinks, which also decreases the water used for melting it. This helps to save water by continuously using gray water to melt ice throughout a shift.

It will be understood from a reading of the detailed description of the preferred embodiments, the objects of the invention and the appended claims that further modifications of the present invention may be made consistent with the scope of the subject matter as taught by the present invention which is to be broadly construed in view of the claims appended hereto. Further while particular details of construction of various components of the apparatus are disclosed herein, various alternative arrangements may be employed. Other modifications and changes in construction of the various components of this invention may also be modified within the spirit and scope of the invention as recited in the appended claims.

I claim:

1. A wash sink and dump sink assembly comprising:

a. a combination sink, comprising of a housing structure with two full length side walls, a full length back wall, a floor, a shorter front wall and four supporting legs;

b. a drainage means situated at the floor of the housing structure;

c. a faucet located at a head of the back wall of the housing structure; and d. a tray structure, dividing the combination sink into a top zone and a bottom zone, resting on removable pegs inserted into the side walls of the housing structure, the tray structure being removable, wherein the tray structure comprises of a back wall, two side walls, a downward inclining floor, the downward inclining floor extending away from the full length back wall and towards the shorter front wall, and a backward recessed portion located at a front extremity of the downward inclining floor, wherein the downward inclining floor allows used water to flow into the bottom zone of the combination sink, further wherein the backward recessed portion is configured to ensure that all of the used water from the top zone, in which the tray structure rests, flows into the bottom zone.

2. The wash and dump sink assembly of claim 1, wherein the side walls of the tray structure comprise slots on which the tray structure rests on the pegs.

3. The wash and dump sink assembly of claim 1, wherein the downward inclining floor of the tray structure is non-porous.

4. The wash and dump sink assembly of claim 1, wherein the downward inclining floor of the tray structure is configured to prevent accumulation of standing water.

5. The wash and dump sink assembly of claim 1, wherein the tray structure is dishwasher safe.

6. The wash and dump sink assembly of claim 1, wherein the tray structure is made of non-corrosive material.

7. The wash and dump sink assembly of claim 1, wherein the top zone is configured exclusively for hand washing.

8. The wash and dump sink assembly of claim 1, wherein the bottom zone is configured for dumping wet waste.

9. The wash and dump sink assembly of claim 1, wherein the tray structure is configured to prevent back splash between the top zone and the bottom zone.

10. The wash and dump sink assembly of claim 1, wherein an automatic sensor controls water flow from the faucet.

11. The wash and dump sink assembly of claim 1, further comprising a tray holder affixed to the shorter front wall.

12. The wash and dump sink assembly of claim 1 wherein water from the faucet is capable of being used to melt dumped ice in the bottom zone.

* * * * *